United States Patent [19]

Kershaw et al.

[11] Patent Number: 5,029,649

[45] Date of Patent: Jul. 9, 1991

[54] BALLAST RECONDITIONING APPARATUS

[75] Inventors: John K. Kershaw; Philip C. McCray, both of Montgomery, Ala.

[73] Assignee: Knox Kershaw, Inc., Montgomery, Ala.

[21] Appl. No.: 615,500

[22] Filed: Nov. 19, 1990

[51] Int. Cl.[5] ..... E01B 27/00; E01B 27/02

[52] U.S. Cl. ..... 171/16; 37/104; 37/106; 37/107; 104/2

[58] Field of Search ..... 104/2; 171/16; 37/104, 37/105, 106, 127

[56] References Cited

U.S. PATENT DOCUMENTS

| | | | |
|---|---|---|---|
| 3,967,396 | 7/1976 | Maosonneuve et al. | 171/16 |
| 4,119,154 | 10/1978 | Miller | 171/16 |
| 4,534,415 | 8/1985 | Theurer et al. | 171/16 |
| 4,674,208 | 6/1987 | Whitaker | 171/16 |
| 4,705,115 | 11/1987 | Whitaker | 171/16 |
| 4,813,488 | 3/1989 | Theurer | 171/16 |
| 4,850,123 | 7/1989 | Whitaker | 171/16 |
| 4,890,557 | 1/1990 | Whitaker | 104/2 |
| 4,967,847 | 11/1990 | Whitaker | 171/16 |

*Primary Examiner*—Randolph A. Reese
*Assistant Examiner*—Spencer Warnick
*Attorney, Agent, or Firm*—Phillips & Beumer

[57] ABSTRACT

Apparatus for excavating ballast from a railroad bed and for cleaning the excavated ballast for return thereof to the railroad bed. The apparatus includes a vehicle for supporting a pair of excavating assemblies on opposite sides of the support vehicle and thus on opposite sides of the railroad track and a discrete cleaning station for each of the separate excavating assemblies. Each cleaning station is disposed for receiving and cleaning the ballast excavated by the associated excavating assembly. Each excavating assembly includes, in spaced, serial relation, a forward excavating wheel, an undercutter, and a second or rear excavating wheel.

11 Claims, 2 Drawing Sheets

BALLAST RECONDITIONING APPARATUS

FIELD OF THE INVENTION

The present invention relates generally to the field of railroad maintenance and particularly to apparatus for reconditioning the ballast at a relatively high rate of speed by providing a discrete reconditioning apparatus for each ballast pick-up assembly.

BACKGROUND OF THE INVENTION

Railroad ballast cleaning machinery is well known in the art. These machines take up the ballast from the track bed, clean the ballast, return the cleaned material to the track, and discard the "dirt" or waste contaminating material. One reason for cleaning the ballast is to provide cleaner ballast which can drain water away from the railroad cross ties in order to ensure a longer "life" for the ties. Over a period of time, the track bed becomes contaminated by mud working its way up from underneath, by dirt getting into the ballast from the top, or by the ballast being slowly ground into small particles by vibration caused as trains pass over the ballast. The ballast becomes so contaminated after a period of time that moisture is held around the ties, thus resulting in deterioration of the ties, which results in expensive tie replacement becoming necessary. Thus, periodic ballast cleaning is necessary to ensure good drainage. A further disadvantage of contaminated ballast is that the track tends to settle in muddy spots, thus destroying the alignment (line) and surface of the rails.

Some types of ballast cleaners are disclosed in U.S. Pat. Nos. 4,705,115, issued on Nov. 10, 1985, to John B. Whitaker, Jr.; 4,850,123, issued on July 25, 1989, to John B. Whitaker, Jr.; 4,534,415, issued on Aug. 13, 1985, to Josef Theurer; and 4,813,488, issued on Mar. 31, 1989, to Josef Theurer. Typically, there are two types of ballast cleaners. One type simply takes up the ballast along the track shoulders (outside the ends of the cross ties) and is known as a "shoulder cleaner." The second type takes up the material underneath and between the cross ties and is known as an "undercutter cleaner."

Normally, a shoulder cleaner utilizes a rotating "ditcher wheel" on each side to take the ballast up from the track shoulder while an undercutter uses a continuous cutter chain to pull the material from underneath the track.

Both of the above-identified patents issued (U.S. Pat. Nos. 4,534,415 and 4,813,488) relate to an undercutter type of apparatus which utilizes a chain-type excavator which requires that the track be raised for the excavation of the ballast. After the ballast cleaning operation is completed, the tracks must be levelled in an attempt to restore the original track line.

A typical ballast reconditioning apparatus which uses a ditcher wheel and undercutter configuration is disclosed in U.S. Pat. No. 4,850,123. The patent is directed to a pair of rotatable undercutters and means for raising, lowering, and horizontally moving the undercutters. The patent also discloses a ditcher wheel mounted forwardly of the undercutters to remove ballast from the shoulders of the railroad bed. In this type of apparatus, forward progress is limited by the speed at which the ballast can be cleaned by the single screen cleaner. Furthermore, the contaminated ballast removed by the undercutter is deposited at the shoulders of the railroad bed (uncleaned) while the ballast removed from the shoulders of the bed by the ditcher wheels are transported to a single cleaning station having a vibrating screen assembly therein. If it is desirable to remove the uncleaned deposited ballast from the shoulders for cleaning, it is necessary for the ditcher wheels to be raised so that the apparatus can be reversely moved over the excavated area of the railroad bed and another pass made to pick up the deposited ballast from the shoulders by the ditcher wheels.

As can be seen, the production rate of such apparatus is unduly restricted if all of the excavated ballast is to be reconditioned. The rate and amount of ballast cleaning is severely limited since only a single cleaning station is provided. Also, the requirement for repeated passes over the area to recondition all of the excavated ballast is time consuming (and costly).

U.S. Pat. No. 4,705,115 discloses a ballast reconditioning system having two ditcher wheels, one on each side of the vehicle frame, and an undercutter mounted rearwardly of each ditcher wheel to remove ballast from beneath the tracks. The ballast removed from the shoulders of the railroad bed by the ditcher wheels is transported rearwardly of the undercutter to be directly discharged (without cleaning) onto the center of the track to replace the ballast removed by the undercutter. The apparatus of U.S. Pat. No. 4,705,115 uses conveyor belts to transport the ballast picked up by the ditcher wheels to the rear of the undercutter and onto the center of the track and also to transport the ballast picked up by the undercutter to the single ballast screen cleaner. A clean ballast return receives the cleaned ballast and returns it to the shoulders of the railroad bed.

The forward speed of the apparatus is severely limited since only a single ballast screen is provided for cleaning the ballast. Furthermore, it should be noted that the shoulder ballast which is returned (uncleaned) to the center of the track still contains a large amount of contaminants such as mud, small dust particles, etc., and will not provide the high degree of drainage afforded by a track bed having clean shoulder ballast. As a result of not cleaning all of the excavated ballast in a single operation, more frequent periodic maintenance is required.

Apparatus of the present invention overcomes the above-noted difficulties by providing a ballast reconditioning system having two pairs of spaced ditcher wheels and an undercutter mounted on opposite sides of a supporting frame. The undercutter is positioned between each ditcher wheel of each pair of ditcher wheels. A discrete cleaning station is provided for each pair of ditcher wheels. The first ditcher wheel (forward wheel) of each pair of wheels removes ballast from both shoulders of the railroad bed to clear the way for the undercutter to extend under the cross ties and remove the ballast from under the cross ties and deposit the removed ballast on the shoulders. This deposited ballast is then picked up by the second ditcher wheel of each pair of ditcher wheels and transported to a second cleaning station.

SUMMARY OF THE INVENTION

It is, therefore, an object of the present invention to provide a system for removing ballast from along the shoulder of a railroad track and from under the cross ties supporting the track.

It is another object of the present invention to provide such a system which will accomplish the ballast cleaning operation in a rapid and facile manner so as to minimize the "down" time of the railroad track.

It is a further object of the present invention to provide such a ballast cleaning system which is capable, in a single pass of the apparatus, of excavating ballast from along both shoulders and from beneath the cross ties of a railroad bed and reconditioning all of the excavated ballast and replacing the excavated ballast onto the railroad bed.

A feature of the present invention is the provision of a ballast cleaning system with two pairs of ditcher wheels and a pair of undercutters with one pair of ditcher wheels and one undercutter being disposed on a first side of a vehicle frame and a second pair of ditcher wheels and an undercutter disposed on the opposite side of a vehicle frame.

Another feature of the present invention is the provision of a pair of cleaning stations, each station being associated with only one undercutter and one pair of the ditcher wheels to receive ballast picked up by only the associated pair of ditcher wheels and undercutter.

DESCRIPTION OF THE PREFERRED EMBODIMENT

Figure 1:
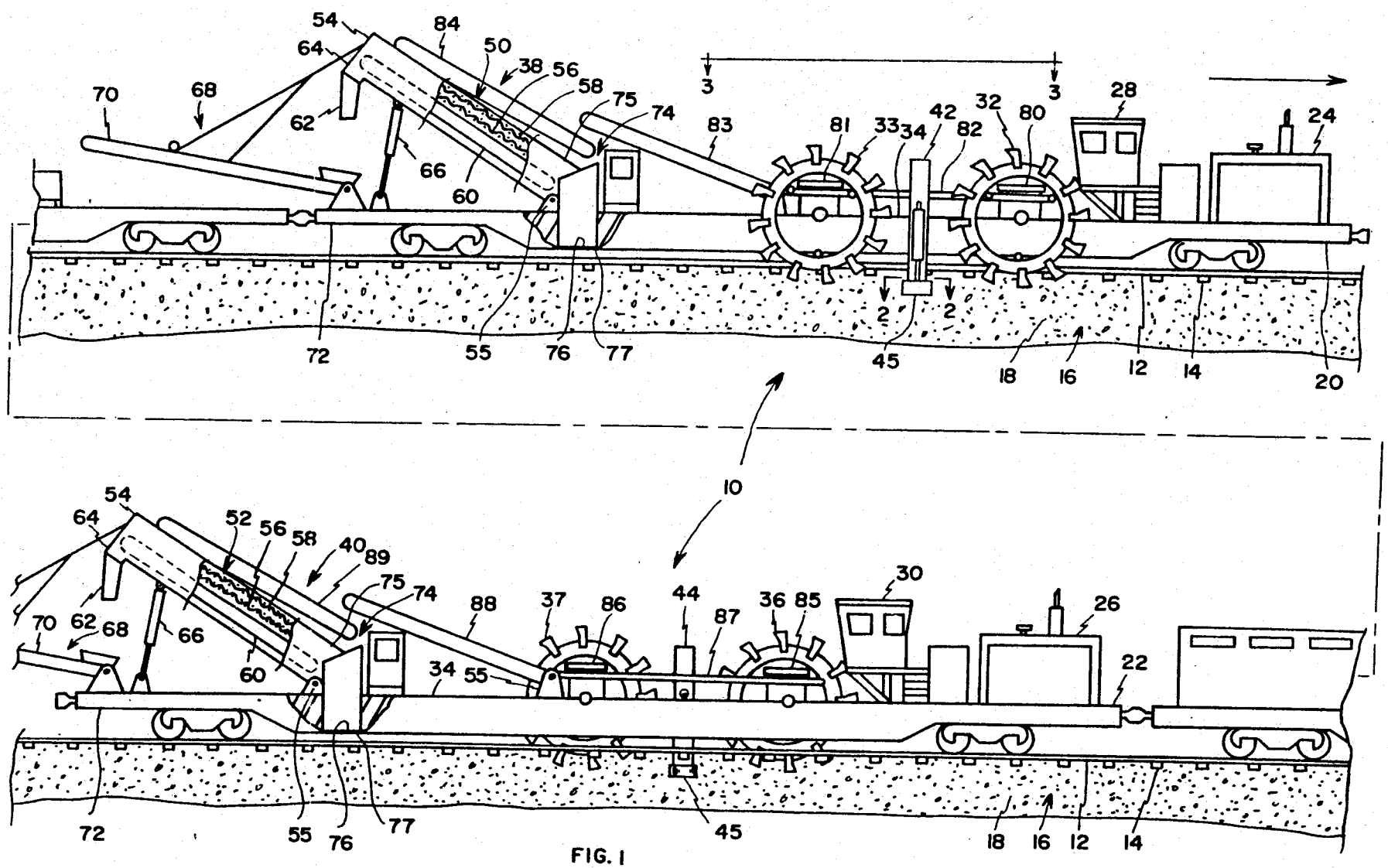
FIG. 1 is an elevational view of the ballast cleaning system of the present invention.
Figure 3:
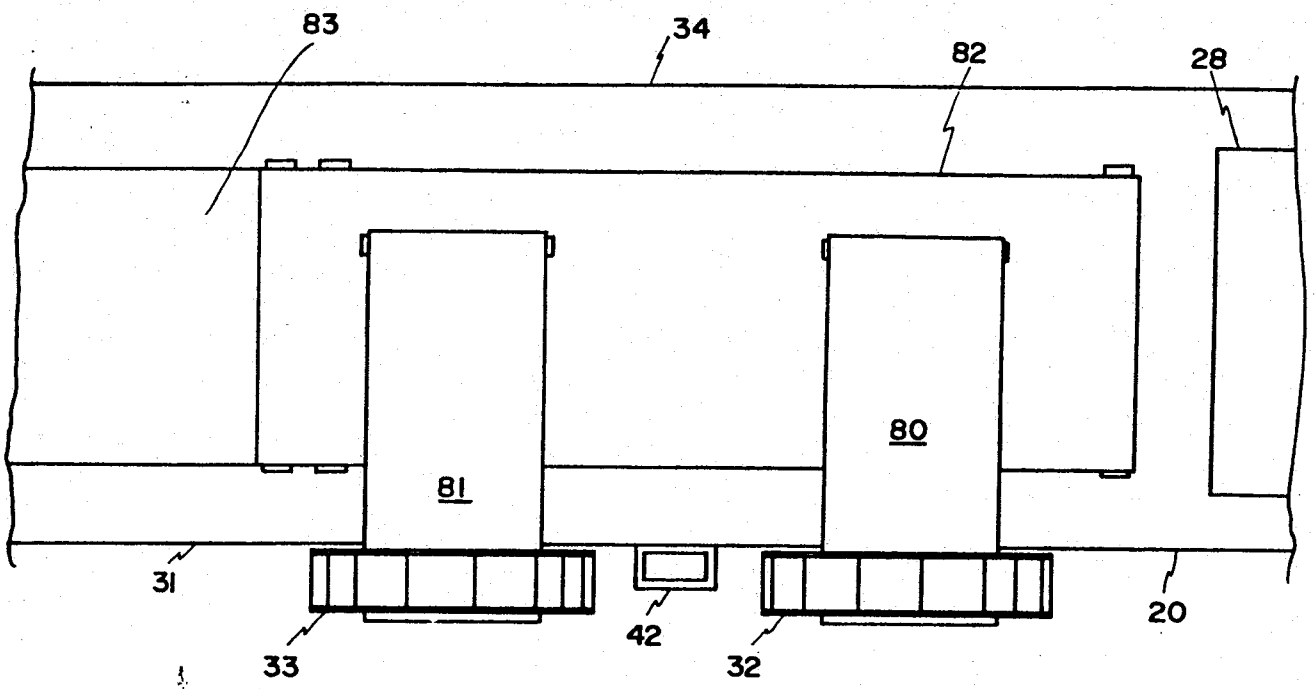
FIG. 3 is a partial top view of one reconditioning and excavating station of the system shown in FIG. 1. The view is taken along line 3—3 of FIG. 1 and illustrates the conveyor system.

As seen in FIG. 1, a ballast reconditioner system 10 is shown supported on a track 12 having cross ties 14 which are supported on a bed 16 comprised of ballast 18. The reconditioner system is provided with a vehicular carrying apparatus, shown to include a pair of vehicle frames 20 and 22 having power units 24 and 26, respectively, which propel the system and provide the motive power for driving various components of the system. An operator occupies cabs 28 and 30 carried on vehicle frames 20 and 22, respectively. The cabs are equipped with conventional control mechanisms which are conventionally connected to the various components for operation thereof.

A first pair of ditcher wheels are shown mounted rearwardly of cab 28 on a first side 31 of frame 20, and a second pair of ditcher wheels are shown mounted rearwardly of cab 28 on a second side 34 of frame 22. The first pair includes a forward ditcher wheel 32 disposed in spaced relation with a rear ditcher wheel 33. The second pair of ditcher wheels includes a forward ditcher 36 disposed in spaced relation with a rear ditcher wheel 37. Cleaning stations 38 and 40 are respectively disposed rearwardly of the ditcher wheels 32, 33 and 36, 37, respectively, so that each pair of ditcher wheels has its own associated cleaning station.

A first excavating member (undercutter) 42 is disposed on frame 20 intermediate ditcher wheels 32 and 33, and a second excavating member 44 is disposed on frame 22 intermediate ditcher wheels 36 and 37. Excavating members 42 and 44 are each provided with a lower base portion 45 having a projecting portion (tooth) 46 (FIG. 2) which is arranged to project under the ends of the cross ties to remove ballast which is underneath the cross ties. The excavating members may be rotatable or stationary. However, it is necessary that the excavating members be capable of being raised and lowered so that they may be movable into operating position when in their lowered position and out of operation (such as when travelling to a work site) when in their raised position. It is also desirable that the projecting tooth portion of the excavating member be capable of inward movement a predetermined distance under the cross ties and outward movement to be clear of the ends of the cross ties.

Figure 2:
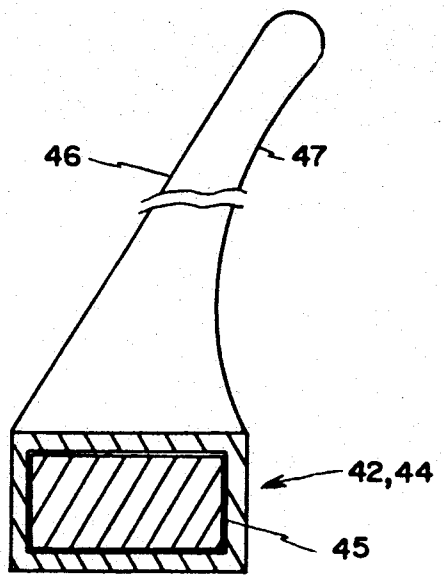
FIG. 2 is a sectional view taken along line 2—2 of FIG. 1.

Excavating members 42 and 44, shown in FIGS. 1 and 2, are non-rotatable and define a scarifier tooth. Such stationary excavating members include the base portion 45 from which the inwardly projecting (tooth) portion 46 extends. Each projecting tooth portion includes a forward ballast contacting surface 47 which is disposed in angular relation to the base portion. The angular relation permits the projecting (tooth) portions to remove the ballast from under the track and deposit the ballast adjacent to the track as the apparatus moves along the track. Mechanisms for controlling movement (raising, lowering, horizontal replacement, etc.) of the excavating members is well known in the art. U.S. Pat. No. 4,850,123 discloses a rotary excavating member which may be movably mounted.

Hydraulic cylinders and associated hydraulic mechanisms such as pumps, lines, valves., etc. (not shown), may be provided and operable by the operator in the cab for actuating and controlling the various components of the system. Such hydraulic mechanisms are well known in the art. Also, as shown in FIG. 1, additional vehicle frames may be provided for carrying supplies, spare parts, etc.

It is to be understood that the cleaning stations 38 and 40 are well known in the art. Typically, the cleaning stations include a pair of vibrating screen assemblies generally indicated by the numerals 50 and 52 in FIG. 1. Each assembly includes a pivotally mounted enclosed box-like structure 54 which encloses a pair of screens 56 and 58 and a conveyor belt 60 which is mounted beneath the screens. A vibrating mechanism (not shown), well known in the art, is disposed for vibrating the enclosure. A discharge port 62 is disposed at the rear 64 of enclosure 54 for reasons explained hereinbelow. A hydraulic piston and cylinder assembly 66 is controlled by the operator in the cab to pivot the enclosure 54 around pivot support 55 to raise and lower the enclosure and attendant structure.

Enclosure 54, and thus the screens carried therein, have been designed to operate between 10 degrees and 35 degrees to provide a 25-degree operating range not found in the art. The flatter screen angle (lower elevation) is useful in extremely wet, muddy conditions, since the lower elevation permits the ballast to stay on the vibrating screen for a longer period of time, thus enabling the extremely dirty ballast to be vibrated for a longer period of time to better clean the ballast. The production rate is necessarily decreased during this time, but such procedure enables the apparatus to work on wet days (when otherwise work would be impossible). The steep angle (35 degrees) allows maximum production when conditions are dry enough for good cleaning efficiency with a minimum of time on the screen.

A waste conveyor assembly 68 is provided and includes a conveyor 70 which is movable to either the rear of the vehicle frames or to the sides of the vehicle frame. Conveyor 70 is mounted at the rear 72 of the vehicle frames beneath discharge port 62 of the vibrating enclosure 54 to receive and discharge the contaminants and debris from port 62.

To return the "cleaned" ballast to the track bed, a hopper 74 is provided at the forward end 75 of enclosure 54 to receive the cleaned ballast from the cleaning station and to direct the ballast to the track bed through opening 77 in the bottom of the hopper. A pair of hydraulically-operated closure members 76 are mounted in adjacent relation in an opening 77 disposed in the bottom of each hopper to control the flow of the ballast back to the track bed. Each of the hydraulically-operated doors is independently actuated so that the flow of ballast may, for example, be permitted to flow through the right side of the hopper to be directed to the right side of the track to replace ballast removed by the right ditcher wheel, and vice versa. Or, if desired, both closure members may be opened to permit ballast flow on both sides of the track center line.

In operation, the apparatus is moved along the track, and the forward ditcher wheel (wheels 32 and 36) of each pair of ditcher wheels continuously picks up the ballast adjacent to the opposite cross ties. Excavating members 42 and 44 follow the respective forward ditcher wheels 32 and 36 and project under the cross ties to remove ballast therefrom. The ballast removed by the excavating members 42 and 44 is deposited at the shoulder of the railroad bed to be picked up by the rear ditcher wheels 33 and 37. The ballast from ditcher wheels 32 and 33 is respectively deposited on transverse conveyor assemblies 80 and 81, which deposit the excavated ballast onto a first longitudinally-extending conveyor assembly 82, which deposits the ballast on a tilted second longitudinally-extending conveyor assembly 83. The ballast is then deposited on a third conveyor assembly 84 (FIG. 1) which is angled upwardly to continually deposit the ballast in the rear 64 of raised enclosure 54 of frame 20. In like manner, and as shown in FIG. 1, the ballast picked up by ditcher wheels 36 and 37 is respectively deposited on transverse conveyor assemblies 85 and 86 which deposit the excavated ballast onto a longitudinally-extending conveyor assembly 87, which deposits the ballast on a tilted, second longitudinally-extending conveyor assembly 88. The ballast is then deposited on a third conveyor assembly 89 which is angled upwardly to continually deposit the ballast in the rear 64 of raised enclosure 54 of frame 22. Enclosures 54 are vibrated, by means well known in the art, to shake the contaminants (dust, mud, small particles, etc.) from the ballast, which falls through the openings in screens 56 and 58 to conveyors 60. The smaller contaminants are carried by conveyor 60 to discharge chutes 62 and are discharged onto conveyor assemblies 68 which empties the contaminants to sides of the vehicle frames away from the railroad bed. If desired, conveyor 68 can be made to empty the contaminants into a "waste" car carried behind the vehicle frames.

The cleaned ballast is caused to move down the screens by the vibratory movement of the tilted enclosure and is emptied into its respective hopper 74 and directed through the opening 77 in the bottom of the hopper to the track bed in the manner previously described. If desired, scraper and sweeper assemblies (not shown) may be positioned beneath the vehicle frame behind the hopper to smoothly distribute the cleaned ballast as it is deposited along the track bed.

It is to be understood that while the apparatus of our invention is described as having a pair of vehicle frames each having a reconditioning apparatus including a ditcher wheel, an undercutter, and conveying mechanism mounted thereon, this is not to be taken in a limiting sense since both reconditioning apparatuses may be carried by a single vehicle frame, if desired.

It is to be also understood that while a specific conveyor arrangement for each frame is shown to include three longitudinal conveyors and two transverse conveyors, other arrangements for transporting the ballast to the cleaning stations may be resorted to that are within the spirit and scope of the present invention.

It is to be further understood that while the invention has been described with reference to the details as set forth above, it is not to be limited to the specific structure as disclosed, and the invention is intended to cover any modifications or changes as may come within the scope of the following claims.

We claim:

1. Apparatus for reconditioning ballast along a railroad bed having track supporting cross ties carried thereon comprising:

vehicular support means disposed for movement along the said railroad bed, said vehicular support means having first and second sides;

first and second excavating means for excavating ballast from adjacent the ends and beneath said cross ties, each of said first and second excavating means comprising a first excavating wheel disposed for driven rotation for excavating ballast from adjacent the ends of said cross ties, an undercutter mounted rearwardly of said first excavating wheel for excavating ballast from beneath said cross ties, and a second excavating wheel mounted rearwardly of said undercutter for excavating ballast removed by said undercutter;

said first excavating means mounted on said first side of said vehicular support means and said second excavating means mounted on said second side of said vehicular support means; and a pair of discrete cleaning stations, each cleaning station carried by said vehicular support means and associated with a respective one of said first and second excavating means for independently cleaning said ballast excavated by said associated excavating means.

2. Apparatus as set forth in claim 1 including discrete ballast discharge means carried on said vehicular support means to respectively receive cleaned ballast from each said cleaning station and for directing said clean ballast back to said railroad bed.

3. Apparatus as set forth in claim 2 wherein said discharge means includes hopper means carried by said vehicular support means for receiving cleaned ballast from each said cleaning station and redepositing said cleaned ballast to said railroad bed.

4. Apparatus as set forth in claim 3 including conveyor means for conveying ballast from said first and second excavating means to their respective cleaning station for reconditioning said ballast prior to the discharge thereof by said discharging means.

5. Apparatus as set forth in claim 4 including contaminant discharge means associated with each said cleaning station to discharge the waste contaminants removed at each said cleaning station from said excavated ballast.

6. Apparatus as set forth in claim 5 wherein each said cleaning station includes an enclosure having screen receiving means therein to receive said excavated ballast thereon and a contaminant removal means to remove said contaminants from said enclosure, said enclosure disposed for vibratory movement to displace contaminants from said ballast onto said contaminant removal means.

7. Apparatus as set forth in claim 6 including actuating means for elevating said enclosure to a predetermined operating elevation.

8. Apparatus as set forth in claim 7 wherein said predetermined operating level is in the range of 10 degrees to 35 degrees.

9. Apparatus as set forth in claim 8 wherein said undercutting means comprises a non-rotatable, substantially vertical support means having a base portion provided with a projecting member disposed for reaching inwardly of the ends of said cross ties.

10. Apparatus as set forth in claim 9 wherein said vehicular support means is a pair of vehicle frames disposed in tandem relation, the first of said vehicle frames having the first of said pair of cleaning stations mounted thereon in communication with said first excavating means to receive the excavated ballast therefrom, and the second of said vehicle frames having the second of said pair of cleaning stations mounted thereon in communication with said second excavating means to receive the excavated ballast therefrom.

11. Apparatus as set forth in claim 1 wherein said vehicular support means is a pair of vehicle frames disposed in tandem relation, the first of said vehicle frames having the first of said pair of cleaning stations mounted thereon in communication with said first excavating means to receive the excavated ballast therefrom, and the second of said vehicle frames having the second of said pair of cleaning stations mounted thereon in communication with said second excavating means to receive the excavated ballast therefrom.

* * * * *